US006732686B1

(12) United States Patent
Maeda et al.

(10) Patent No.: US 6,732,686 B1
(45) Date of Patent: May 11, 2004

(54) VALVE OPENING MECHANISM

(75) Inventors: Yoshihide Maeda, Hino (JP); Hisaki Torisaka, Hino (JP); Zdenek Meistrick, Bloomfield, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/890,150

(22) PCT Filed: Jan. 27, 1999

(86) PCT No.: PCT/JP99/00330

§ 371 (c)(1),
(2), (4) Date: Aug. 31, 2001

(87) PCT Pub. No.: WO00/45035

PCT Pub. Date: Aug. 3, 2000

(51) Int. Cl.[7] ..... F01L 1/34

(52) U.S. Cl. ..... 123/90.16; 123/90.39; 123/321

(58) Field of Search ..... 123/90.39, 90.41, 123/90.45, 90.46, 321, 90.12, 90.16

(56) References Cited

U.S. PATENT DOCUMENTS 2,036,936 A * 4/1936 Halford ..... 123/90.46
3,367,312 A * 2/1968 Jonsson ..... 123/321
4,624,224 A * 11/1986 Kodama et al. ..... 123/90.46
4,644,914 A * 2/1987 Morita et al. ..... 123/90.55
4,656,976 A * 4/1987 Rhoads ..... 123/90.12
5,546,914 A * 8/1996 Scheinert ..... 123/568.14
5,626,116 A * 5/1997 Reedy et al. ..... 123/321
5,692,469 A * 12/1997 Rammer et al. ..... 123/321
5,794,589 A * 8/1998 H.ang.kansson ..... 123/321
5,803,038 A * 9/1998 Ihara et al. ..... 123/321
5,857,438 A * 1/1999 Barnard ..... 123/90.16
5,890,469 A * 4/1999 H.ang.kansson et al. .... 123/321

FOREIGN PATENT DOCUMENTS

JP 60252113 A * 12/1985 ..... F01L/13/06

* cited by examiner

*Primary Examiner*—Thomas Denion
*Assistant Examiner*—Jaime Corrigan
(74) *Attorney, Agent, or Firm*—Collier Shannon Scott, PLLC

(57) ABSTRACT

The present invention is a valve opening mechanism which has been designed so as to be able to open an actuator pin (30), on which a stop (31) is provided that is through-mounted to slide freely facing in a vertical direction in relation to the top of a rocker arm (7) and which is restrained by the bottom of the rocker arm (7) tip at a specified uppermost position, and the engine valves (4), by pushing downward during the exhaust stroke of a rocker arm (7).

3 Claims, 7 Drawing Sheets

VALVE OPENING MECHANISM

TECHNICAL FIELD

This invention relates to a valve opening mechanism which is distinct from conventional valve opening mechanisms in that it is constituted so as to be capable of opening an engine valve with suitable timing by the means of a rocker arm.

BACKGROUND ART

The compression pressure release type of engine braking, which is constituted so that it releases pressure within a combustion chamber that has been raised by the movement of pistons through the opening of an exhaust valve in the proximity of top dead center compression, and magnifies engine braking power by diminishing the energy that drives the pistons downward in an expansion stroke, is generally known.

FIGS. 1 through 3 represent examples of the conventional compression pressure release type of engine braking. In FIG. 1, the number 1 identifies the cylinder, 2 the combustion chamber, 3 the piston, 4 the exhaust valve, and 5 the exhaust port, respectively, and they are configured so that the base extremity is thrown upward by a push rod 6 and both exhaust values 4 are pushed downward and opened through the use of the cross head by the tip of an inclining exhaust rocker arm 7, and exhaust gas is scavenged from the combustion chamber 2 toward the exhaust port 5.

Then, when both exhaust values 4 are pushed downward and opened through the use of the cross head 8 by the tip of the above-mentioned exhaust rocker arm 7, the tip of the above-mentioned exhaust rocker arm 7 pushes downward on the master piston 12 provided in the upper portion of the housing 11, a separate slave piston 14 in the upper part of the housing 11 is driven downward by the generation of pressure in the oil line 13 which protrudes into the interior of the above-mentioned housing 11 and, through the use of an actuator pin 15 installed on one side of the cross head 8, an exhaust valve 4 on one side is positioned so that it can be pushed downward independently by the said slave piston 14.

Namely, through the action of the master piston 12 in a separate cylinder 1 that constitutes an exhaust stroke, a cross linkage coinciding with the stroke timing is established by the oil line 13 between the slave piston 14 of the cylinder 1 and the master piston 12 such that the slave piston 14 in the cylinder 1 which is in proximity to top dead center compression is driven, and it is designed in such a way that operating oil 18 (engine oil) is supplied through the use of a solenoid valve 16 and a control valve 17, which constitutes a means of supplying operating oil that switches back and forth between the sustaining and release of oil pressure in the said oil line 13.

At this point, the solenoid valve 16 effects the supply of operating oil 18 by means of a control signal 20 from a control device 19, and the control valve 17 functions as a check valve so that oil pressure in the above-mentioned oil line 13 is sustained when the solenoid valve 16 is in a open state, and also serves to release oil pressure in the above-mentioned oil line 13 when the solenoid valve 16 is in a closed state.

Namely, it is constituted so that, with the solenoid valve 16, the supply of operating oil 18 is effected by the plate 22 and pin 23 pushing downward on the ball 24 when the coil 21 is in energized state, and the supply of operating oil 18 is blocked by the ball 24 being pushed upward by the spring 25 when the coil is in an unenergized state, and also so that, through the use of the control valve 17, the spool 26 is pushed upward by oil pressure when the solenoid valve 16 is in an open state and the transport of operating oil 18 is effected only in the direction of the above-mentioned oil line 13 due to a ball 27 provided inside the said spool 26, and oil pressure is released toward the relief outlet 29 by the spool 26 being pushed downward by the spring 28 when the solenoid valve 16 is in a closed state.

FIG. 2 illustrates a design configuration for multiple cylinders exemplified in the case of a tandem 6-cylinder engine. Only Cylinder #1 (1), Cylinder #2 (1), and Cylinder #3 (1) are depicted, and they are constituted such that the opening action of the exhaust valve 4 in proximity to top dead center compression in Cylinder #1 (1) is taken by the exhaust push rod 6 of Cylinder #3 (1), the opening action of the exhaust valve 4 in proximity to top dead center compression in Cylinder #2 (1) is taken by the exhaust push rod 6 of Cylinder #1 (1), the opening action of the exhaust valve 4 in proximity to top dead center compression in Cylinder #3 (1) is taken by the exhaust push rod 6 of Cylinder #2 (1). More specifically, they are arranged so that the exhaust valve 4 on one side can be opened in proximity to top dead center compression by driving the slave piston 14 of each cylinder with the use of the oil line 13 by means of the action of the master piston 12 using the exhaust rocker arm 7 (not shown in FIG. 2) on the basis of the exhaust push rod 6 of each cylinder.

Furthermore, as 9 in the diagram is an inlet push rod and 10 is an intake valve, it is needless to say that the said intake valve 10 is opened by means of an intake rocker arm (not shown) which is moved at an angle by the inlet push rod 9 during an intake stroke.

Therefore, as the control valve 17 functions as a check valve and closes the oil line 13 if the solenoid valve 16 is opened by a control signal 20 from the control device 19, in the event that Cylinder #1 (1), Cylinder #2 (1), and Cylinder #3 (1), respectively, reach proximity to the pressure top dead center with a different timing, as is indicated in Diagram 3, the master piston 12 is pushed downward by the exhaust rocker arm 7 with an upward thrust of the exhaust push rod 6 for the purpose of opening an exhaust valve 4 in a separate cylinder during an exhaust stroke, thus creating pressure in the oil line 13. Since the slave piston 14 of the cylinder 1 in proximity to the pressure top dead center is driven and an exhaust valve 4 on one side is opened, compressed air from the combustion chamber 2 escapes into the exhaust port 5 and the creation of capacity to push the piston 3 downward during the next expansion stroke is lost, thus making it possible to take effective advantage of the braking capacity achieved in the compression stroke.

Moreover, in FIG. 3 (identical for FIG. 9 and FIG. 11, to be referenced later), the vertical axis represents lift (lifting range) and the horizontal axis represents the angle of rotation of the camshaft in Cylinder #1, while the "Δ" figures in the diagram indicate top dead center compression in each cylinder, the curves in the solid lines indicate lift in the exhaust valve 4 in each cylinder, and the curves in the dotted lines indicate the lift in the intake valve 10 (in Cylinder #1, for example, a 0°~180° angle of rotation of the camshaft constitutes a explosive stroke,180°~360° an exhaust stroke, 360°~540° an intake stroke, and 540°~720° a compression stroke, while the phases are shifted with top dead center compression as the origin.)

If the solenoid valve 16 is closed by a control signal 20 from the control device 19, oil pressure in the oil line 13 is released by the control valve 17, and as pressure is not generated inside the oil line 13, the slave piston 14 ceases to be driven and the exhaust valve 4 is opened by normal valve opening operation only during an exhaust stroke and no longer is opened in proximity to top dead center compression.

In implementing the use of this compression pressure release form of engine braking, especially in the case of an OHV type engine as illustrated in FIG. 1, the actuator pin 15 is through mounted on the side of the cross head 8, facing in a vertical direction, and is configured in such a way that only an exhaust valve 4 on one side is opened by pushing the said actuator pin 15 downward with the slave piston 14, but there is a problem with opening up only an exhaust valve 4 on one side in that it is difficult to achieve greater engine braking capacity without being able to release pressure within the combustion chamber more effectively.

Namely, the exhaust rocker arm 7 in an OHV type engine is moved at an angle by linking it with the vertical reciprocating motion of the exhaust push rod 6 through the use of a camshaft not shown in the diagram, so, for example, the movements of the exhaust push rod 6 in proximity to top dead center compression are disregarded and the exhaust rocker arm 7 is moved at an angle by the slave piston 14, and as a result of this there are situations in which risk exists in that the linkage between the exhaust push rod 6 and exhaust rocker arm can end up being disconnected despite both exhaust valves 4 being opened, so the use of a structure in which the exhaust rocker arm 7 is not moved at an angle except during an exhaust stroke has been avoided.

The present invention is one which has been made with a view the aforementioned situation, and its object is to provide a valve opening mechanism which is designed in such a way that all engine valves that are opened by a rocker arm will be able to be opened separately without inclining a rocker arm.

DISCLOSURE OF THE INVENTION

The present invention is one that has been equipped with a rocker arm that activates to open by pushing the base extremity upward with a push rod and by pushing a engine valve downward with a tip at the time of its angular movement, and an actuator pin which is through mounted to slide freely facing in a vertical direction relative to the tip of the said rocker arm and fitted with a hook stop by which the bottom of the tip of the rocker arm is restrained at its designated top position, and which involves a valve opening mechanism characterized in that it has been constructed so as to enable the opening of engine valves by pushing downward on the said actuator pin during the exhaust stroke of the above-mentioned rocker arm.

However, if the actuator pin is pushed downward during a non-inclined motion of the rocker arm, the said actuator pin will slide in a downward direction against the tip of the rocker arm, and the engine valves will be opened, in an identical manner to that which occurs with a rocker arm, with the actuator pin being pushed downward to the same point as the tip of the rocker arm is being pushed down to during a normal valve opening operation.

Furthermore, when the rocker arm is moved at an angle by the push rod to perform a normal valve opening operation, the actuator pin is fixed in its designated top position due to the fact that a hook stop is held to the bottom of the tip of the rocker arm and, with the use of that fixed actuator pin, the engine valves are pushed downward and opened by the tip of the rocker arm.

It is additionally desirable in the present invention that the actuator pin is constituted by a pin base which, having an hook stop at its longitudinal direction midsection, and which is through-mounted to slide freely in the area above the said hook stop and faces in a vertical direction in relation to the tip of the rocker arm, is also formed in a spherical shape on its lower extremity, and by a tip which maintains contact with the spherically-shaped component on the lower extremity of the said pin base through the use of a spherical sheet and which has a flat tread that pushes downward on the engine valves beneath it.

If done this way, even if the pin base of the actuator pin is inclined by the angular movement of the rocker arm, the tip on its bottom oscillates reciprocally and the inclination of the above-mentioned pin base is permitted when the rocker arm is moved at an angle by the push rod to perform a normal valve opening operation. On this basis, the above-mentioned tip is kept in this very posture whereby it comes into satisfactory contact with the bottom of the flat tread surface that faces toward the engine valves, so as a result, a normal valve opening operation by means of a rocker arm can be reliably executed without any impediment through the use of an actuator pin that has been fixed in the top position.

It is further preferable in the present invention to provide a master piston that is set into motion by being thrown upward by the base extremity of the rocker arm, a slave piston that pushes downward on the actuator pin at the end of the rocker arm provided in the appropriate cylinder whenever it is connected to the said master piston through the use of an oil line and pressure is generated in the said oil line by the operation of the above-mentioned master piston, and a means of supplying operating oil that switches back and forth to sustain or release oil pressure in the above-mentioned oil line.

Therefore, if oil pressure in the oil line is sustained by a means of supplying operating oil, the master piston is thrown upwards by the base extremity of the said rocker arm and operates whenever the rocker arm is moved at an angle by the push rod. As a result of this, the slave piston is driven by the generation of oil pressure in the oil line, and the engine valves are opened by the downward push of the actuator pin on the end of a rocker arm provided in the appropriate cylinder.

Moreover, pressure is not generated inside the oil line if oil pressure in the oil line is released by a means of supplying operating oil, and thus the slave piston ceases to be driven even if the master piston is moved, only normal valve opening operation is accomplished by the rocker arm, and valve opening operation by the actuator pin ceases to be performed.

BEST CONFIGURATIONS FOR EMBODIMENT OF THE INVENTION

The following description is made with reference to the drawings.

Figure 1:
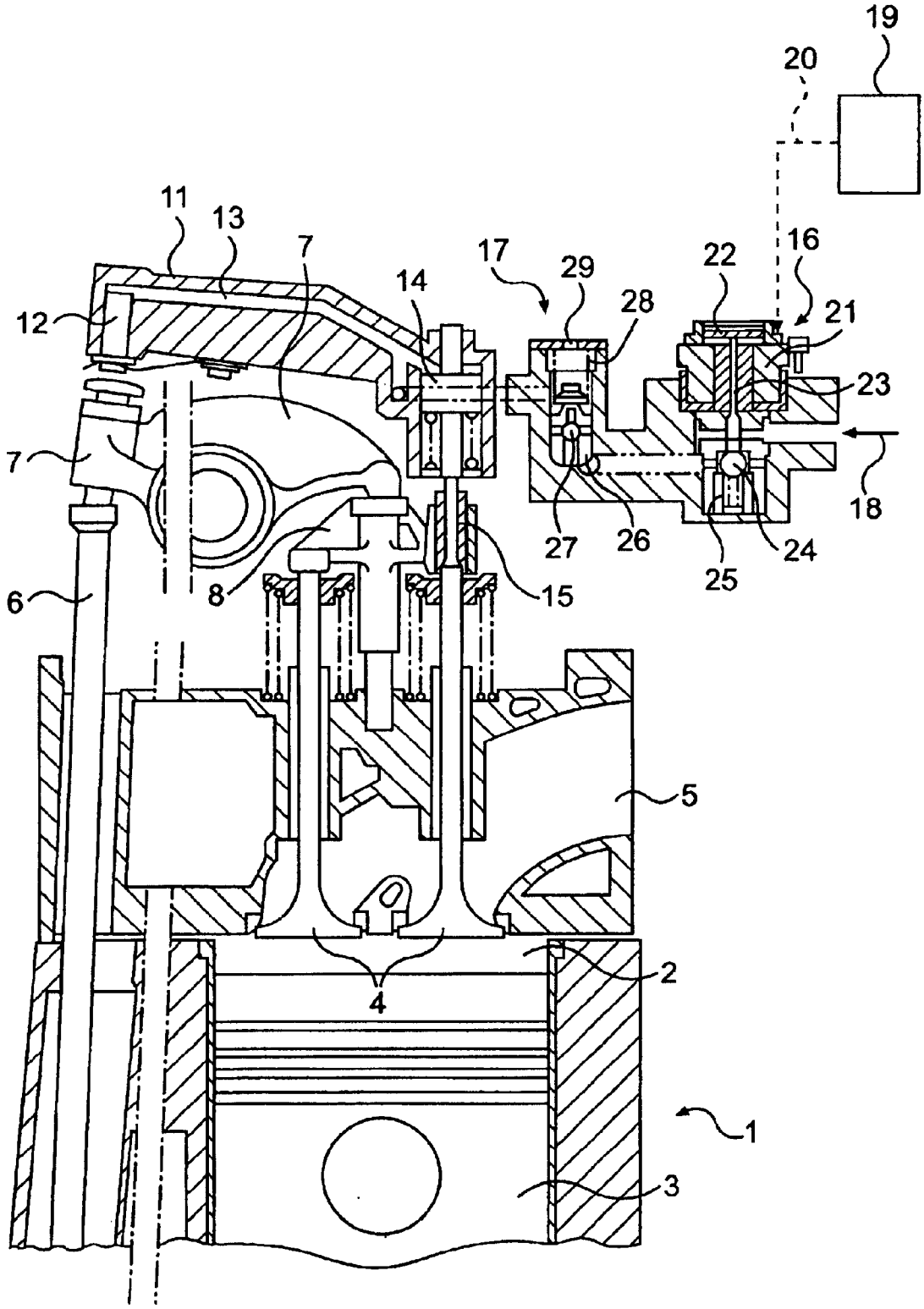
FIG. 1 is a cutaway view showing prior examples.
Figure 2:
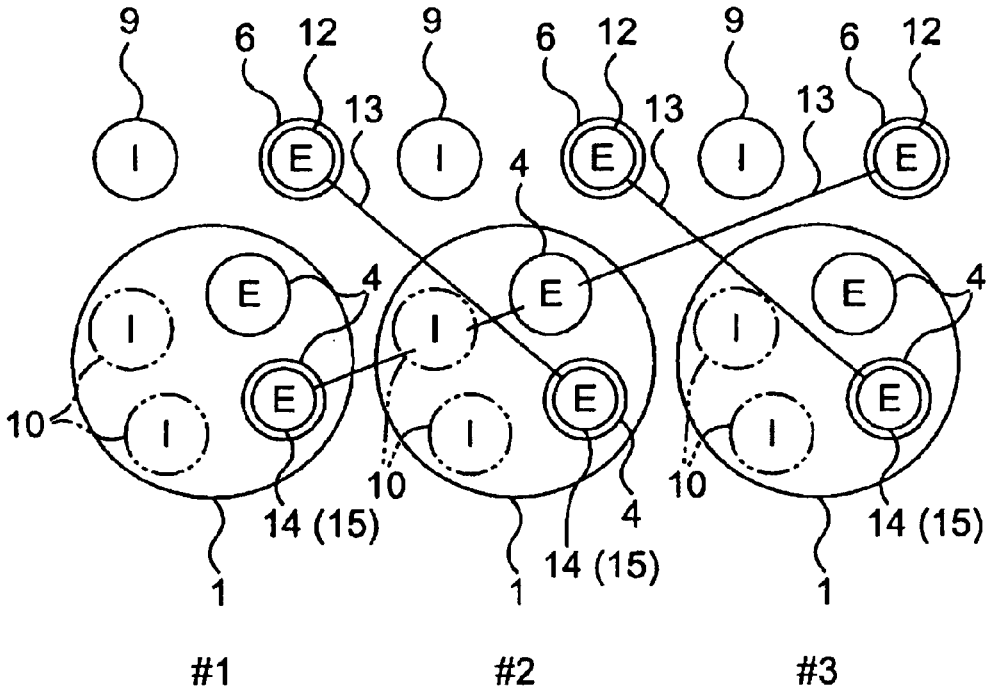
FIG. 2 is a schematic diagram representing the alignments for multiple pistons in previous examples.
Figure 3:
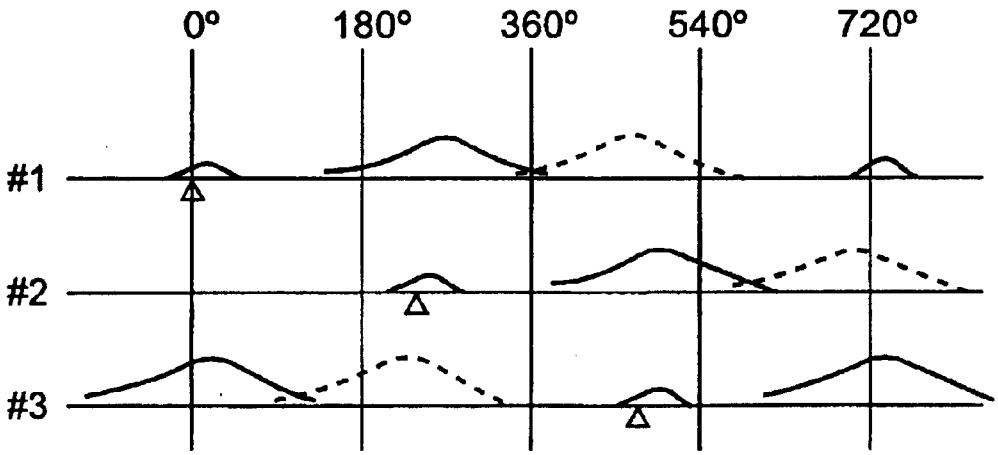
FIG. 3 is a graph illustrating the operating timing of the exhaust valves in FIG. 2.
Figure 4:
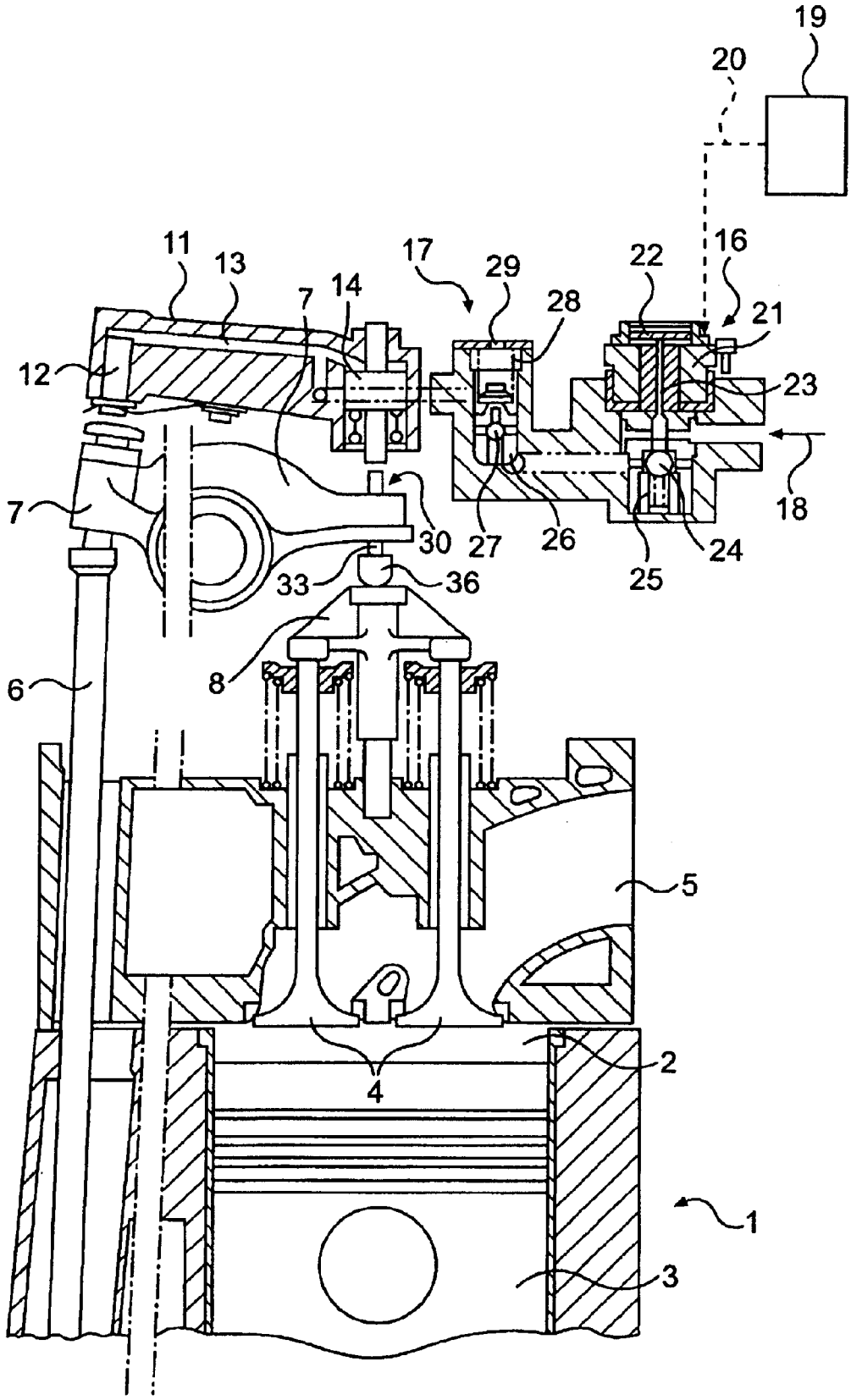
FIG. 4 is a cross-section diagram that illustrates the first example configuration of the present invention.
Figure 5:
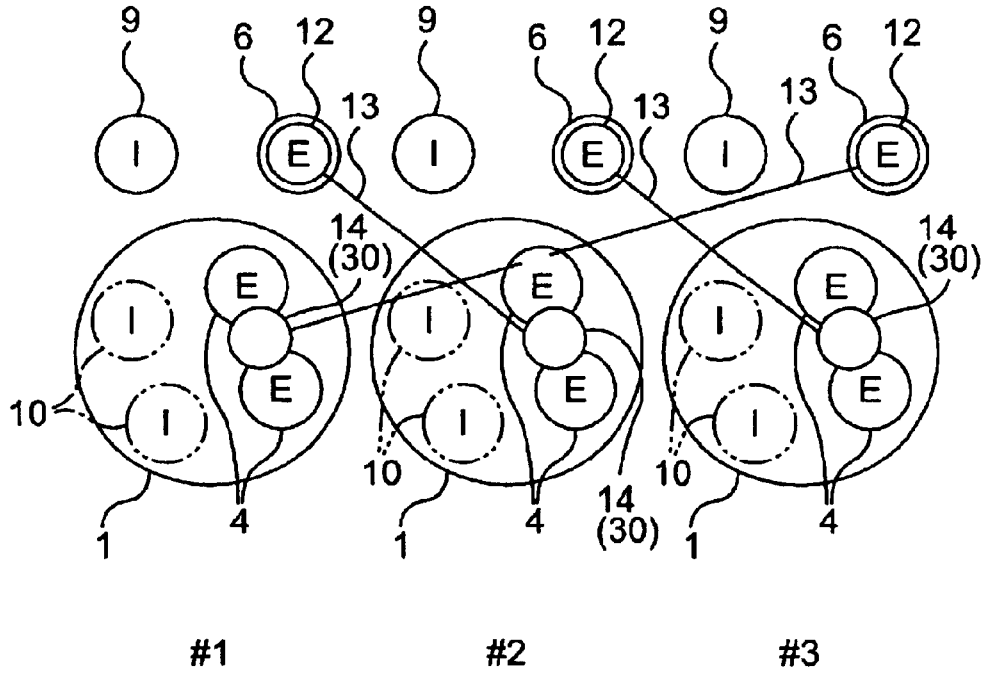
FIG. 5 is a schematic drawing illustrating the alignment for multiple pistons in the first embodiment of the present invention.
Figure 6:
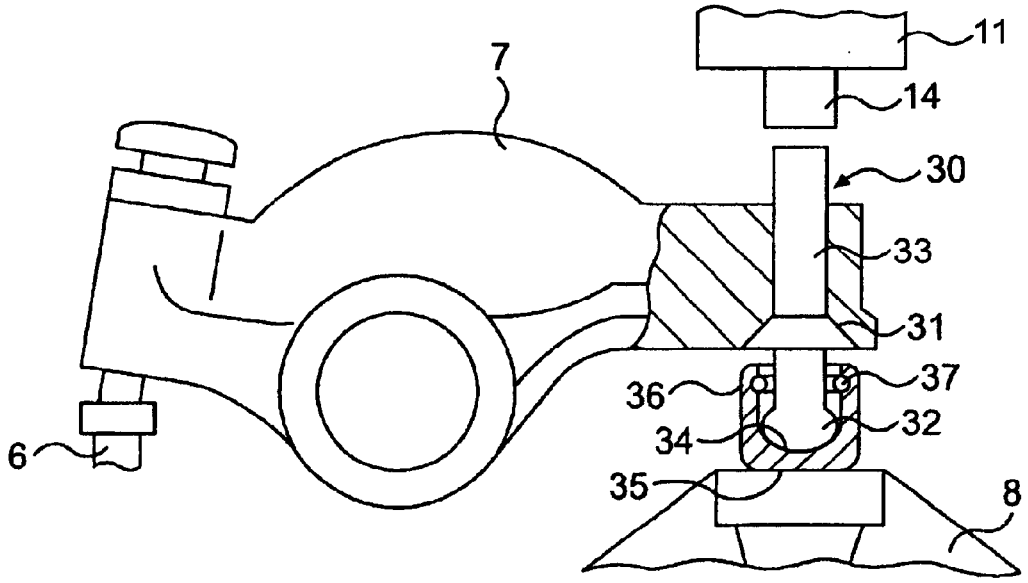
FIG. 6 is a magnified view in which a portion has been cut away to show the details of the actuator pin in FIG. 4.
Figure 7:
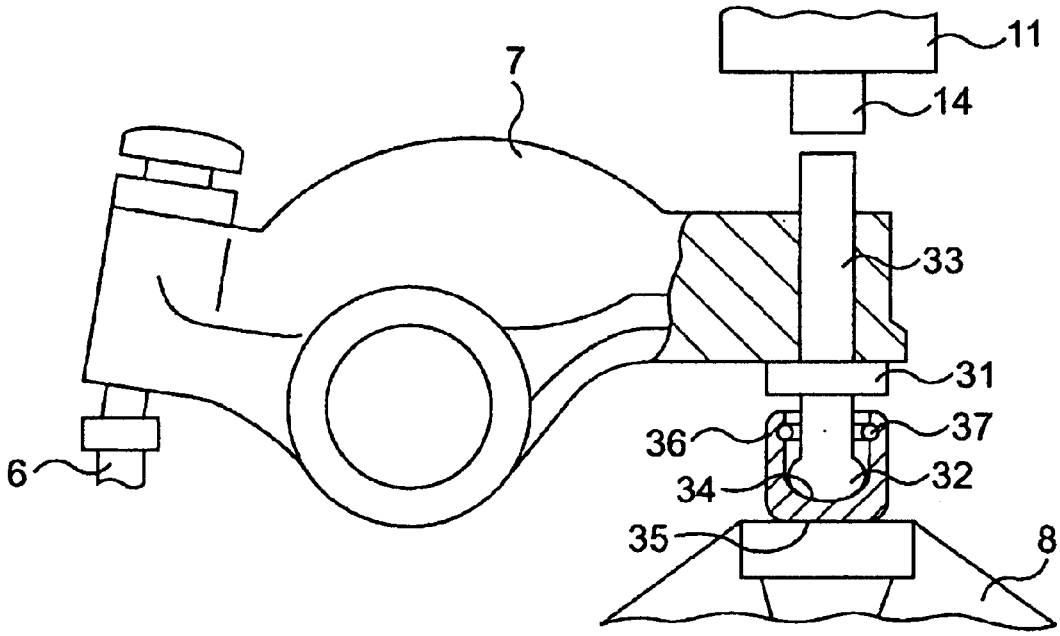
FIG. 7 is a magnified view in which a portion has been cut away to show another example of an actuator pin.

FIGS. 4~6 show an embodiment of this invention which is based on an application of the compression pressure release engine brake described in FIGS. 1~3. Therefore, a presentation of the previously-described constituents using the same symbols is omitted here.

As shown in FIG. 4, as opposed to having the actuator pin installed so that it passes through one side of the cross head 8, in this form of the invention the actuator pin 30 is installed so that it slides up and down relative to the tip of the rocker arm 7, a slave piston 14 is disposed directly above the actuator pin 30, and the actuator pin 30 is pushed down by the slave piston 14 so that exhaust valves 4 on both sides are opened via the cross head 8.

FIG. 5 shows an example of an in-line 6-cylinder engine wherein the opening of the exhaust valve 4 of the first cylinder #1 (1) near compression top dead center is done by the third cylinder #3 (1) exhaust pushrod 6; the opening of the exhaust valve 4 of the second cylinder #2 (1) near compression top dead center is done by the first cylinder #1 (1) exhaust pushrod 6; the opening of the exhaust valve 4 of the third cylinder #3 (1) near compression top dead center is done by the second cylinder #2 (1) exhaust pushrod 6; and the cylinder 1 slave pistons 12 and master pistons 12 are interconnected by hydraulic routes 13 so that the timing of the exhaust strokes for the other cylinders 1 is such that the operation of the master piston 12 follows the operation of the cylinder 1 slave pistons 14 near compression top dead center.

As shown in FIG. 6, the actuator pin 30 has a stop area 31 in the central area along its length and comprises a pin body 33 above it which is installed through and slides up and down in relation to the end of the rocker arm 7, and which is formed with a rounded area 32 on its lower end, and this rounded area 32 on the lower end of the pin body is held so that it moves in a rocking motion with a rounded seat 34 interposed, and so that the pin body 33 pushes the exhaust valve 4 downward via the crosshead 8 by means of a flat area 35 on its tip 36, and this stop area 31 stops movement at the desired upper limit at the bottom of the end of the exhaust rocker arm 7.

A ring part 37 is inserted from the top of the rounded seat 34 of the top 36, and this ring part 37 serves to hold the rounded area 32 of the lower end of the pin body 33 so it does not come out.

Also, although the stop area 31 of the actuator pin 30 is shown with an upward-reducing taper in the figure, it could equally well be formed as a flat ring around it.

When the solenoid valve 16 is opened by a control signal 20 from the control device 19, the control valve 17 functions as a check valve, and the hydraulic line 13 is closed. Therefore, when each of the engine's cylinders 1 reaches the vicinity of pressure top dead center according to its own timing, by thrusting the exhaust pushrod 6 upward so that the exhaust valves 4 of the other cylinders 1 which are exhausting can open, the master piston 12 is pushed upward via the exhaust rocker arm 7 and pressure is generated in the hydraulic line 13, the slave piston 14 of the cylinder 1 at compression top dead center follows and goes down, and each slave piston 14 causes the actuator pins 30 on the ends of the exhaust rocker arms 7 to be pushed down.

The actuator pin 30 which is pushed down by the slave piston slides down relative to the end of the exhaust rocker arm 7, and at the same location as the location where the end of the exhaust rocker arm 7 is pushed down in a normal valve-opening operation, which is to say the same as when the actuator pin 30 pushes down the top of the crosshead 8, wherein both exhaust valves 4 are opened so that the compressed air in the combustion chamber 2 escapes efficiently to the exhaust port 5, and there is no force pushing downward generated by the piston 3 during the next compression stroke, enabling the effective use of braking force during the compression stroke.

The exhaust rocker arm 7 is tilted by the exhaust pushrod 6 and the actuator pin 30 is stopped by the stop area 31 on the bottom of the end of the exhaust rocker arm 7 when normal valve opening is performed, thereby fixing the actuator pin 30 in the upper limit position. The top of the crosshead 8 is pushed down to the end of the exhaust rocker arm 7 via the fixed actuator pin 30, and both exhaust valves 4 are thus opened.

At this point, even though the pin body 33 of the actuator pin 30 is tilted by the tilting of the exhaust rocker arm 7, the bottom end of the tip 36 slides correspondingly, allowing the tilt of the pin body 33. As a result, a good contacting position is maintained for the flat bearing surface 35 of the tip 36 relative to the top of the crosshead 8. Therefore, normal valve opening can take be performed by the exhaust rocker arm 7 with absolutely no impediment via the actuator pin 30 which is fixed at the upper limit.

With the solenoid valve 16 closed by a control signal 20 from the control device 19, the hydraulic pressure in the hydraulic line 13 is released by the control valve 17, and since there is no pressure generated in the hydraulic line 13, the slave piston 14 does not follow, and a separate valve opening operation can take place near compression top dead center.

In the above configuration, therefore, other valve-opening operations can be performed near compression top dead center since both exhaust valves 4 are operated by the exhaust rocker arm 7 in the normal exhaust stroke without tilting the exhaust rocker arm 7. Thus, the pressure in the combustion chamber 2 can efficiently escape, greater engine braking force can be obtained, and the problem of broken linkages in the connection area between the exhaust pushrod 6 and the exhaust rocker arm can be avoided.

The above explanation is an application to compression pressure release-type engine braking. However, as shown in FIG. 8, the invention can also be applied to an exhaust gas recycling device wherein each cylinder 1 #1~#3 are provided with both exhaust valves 4 which are opened in the inlet stroke by inlet pushrods 9.

Specifically, a constitution which comprises a master piston 12 located directly above the base point of the inlet rocker arm (not shown) which is thrust upward by the inlet pushrod 9, with the master pistons 12 being connected to slave pistons 14 of their own cylinders by means of hydraulic lines 13, can be obtained in which both exhaust valves 4 operate during the inlet stroke.

Figure 8:
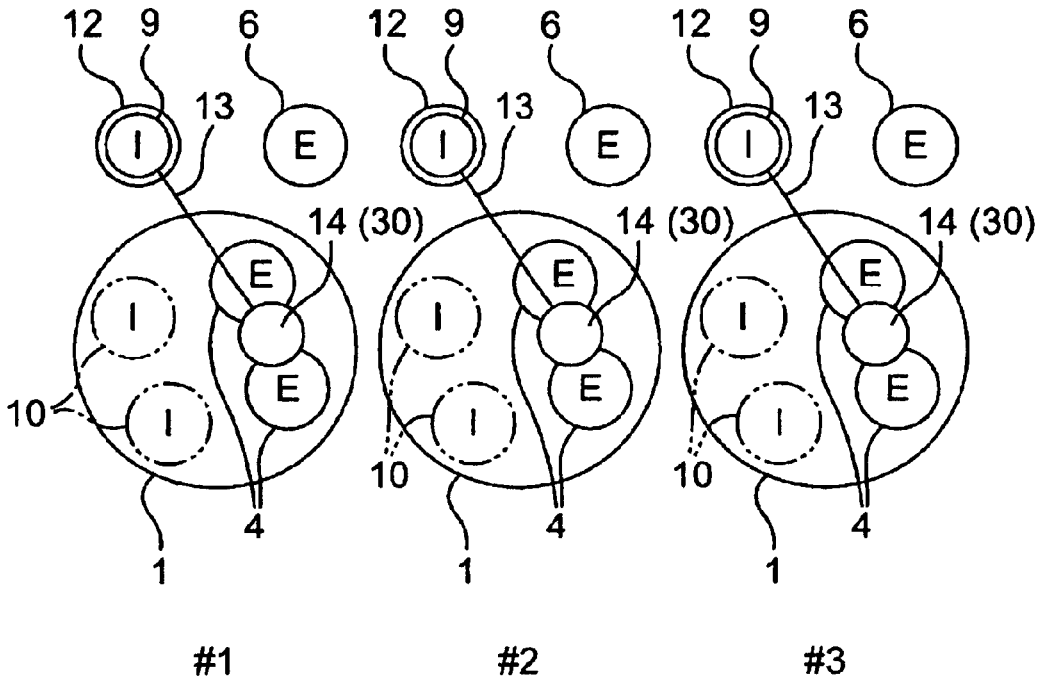
FIG. 8 is a schematic diagram illustrating the alignment for multiple pistons in the second example configuration of the present invention.
Figure 9:
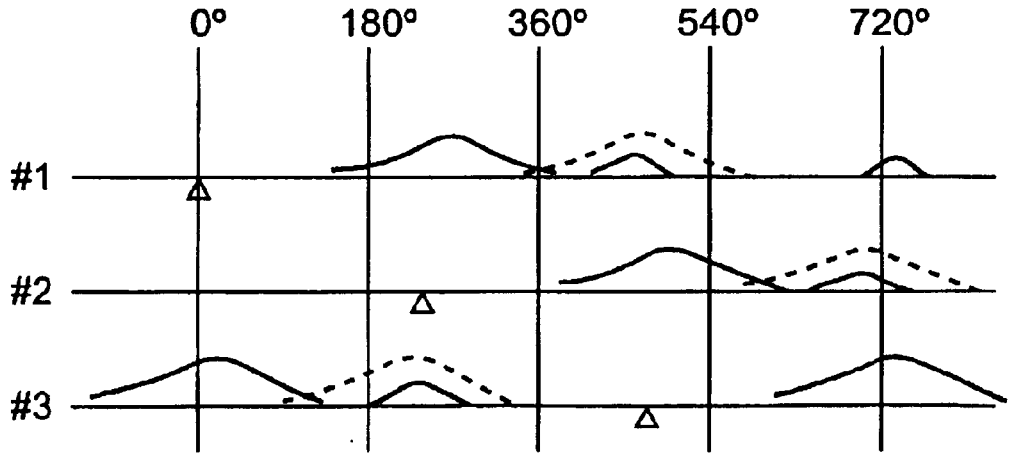
FIG. 9 is a graph representing the operating timing of the exhaust valves in each cylinder in FIG. 8.

In this form, cylinder #1 (1), cylinder #2 (1), and cylinder #3 (1), respectively, as shown in FIG. 8, have inlet strokes taking place according to different timings, as shown in FIG. 9. The inlet rocker arm is tilted by the upthrust of the inlet pushrod 9 to open the inlet valve 10, thus lifting up the master piston 12, and generating pressure in the hydraulic lines 13. The slave piston 14 for this same cylinder 1 follows, opening both exhaust valves 4 via the actuator pins 30. The exhaust gases are recycled from the exhaust port 5 to the combustion chamber 2 due to the pressure differential, and the combustion temperature in the combustion chamber 2 is lowered in the next power stroke, thereby reducing $NO_x$.

Thus, when this sort of exhaust gas recycling device is used, since both exhaust valves 4, which are opened by the exhaust rocker arm 7 in the normal exhaust stroke, can be opened by a separate operation during the normal exhaust stroke without tilting the exhaust rocker arm 7, the exhaust gases in the combustion chamber 2 can be efficiently recycled, a more efficient abatement of $NO_x$ can be achieved, and failures in the linkage between the exhaust pushrod 6 and the exhaust rocker arm 7 can be avoided.

Figure 10:
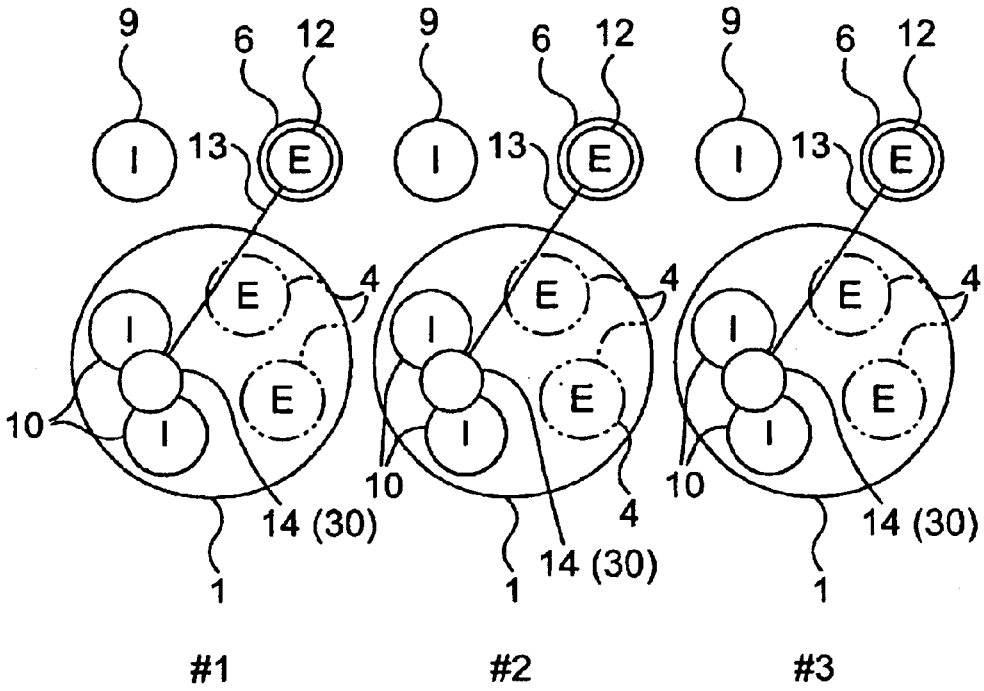
FIG. 10 is a schematic diagram illustrating the alignment for the multiple cylinders in the third example configuration of the present invention.

Also, this exhaust gas recycling device can be configured such as the one shown in FIG. 10, wherein the cylinders (1) #1~#3 are each provided with both exhaust valves 10, and each cylinder's 1 exhaust pushrod 6 opens the exhaust valves 10 in the exhaust stroke.

Specifically, the actuator pin 30 is installed so it slides through in the up-and-down direction relative to the end of the inlet rocker arm (not shown), which is tilted by the inlet pushrod 9. The slave piston 14 is located directly above the actuator pin 30, and the master piston 12 is located directly above the base end of the exhaust rocker arm 7, and the master piston 12 for each cylinder and the slave piston 14 for these same cylinders are connected by a hydraulic line 13.

Figure 11:
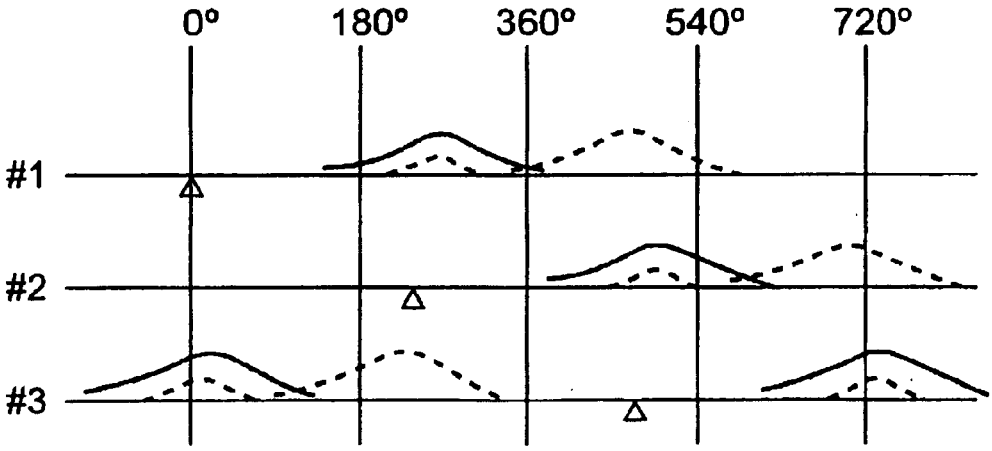
FIG. 11 is a graph depicting the operating timing of the intake valves in each cylinder in FIG. 10.

Cylinders 1 #1, #2, and #3 in FIG. 10, respectively, have different exhaust stroke timings as shown in FIG. 11. The exhaust rocker arm 7 is tilted by the upthrust of the exhaust pushrod 6 in order to open the exhaust valve, and as a result, the master piston 12 is pushed up and pressure is generated in the hydraulic line 13. The slave piston 14 for each cylinder 1 follows, and both inlet valves 10 are opened by means of actuator pins 30. Since a portion of the exhaust gas in the combustion chamber 2 is efficiently swept out toward the inlet port (not shown), the exhaust gas which is swept out toward the inlet port can be recycled for the next inlet stroke in the combustion chamber 2, and the combustion temperature for the next power stroke is reduced $NO_x$ can be abated.

The valve opening mechanism of this invention is not limited to the forms described above. Although the above descriptions have been presented assuming a straight 6-cylinder configuration, the invention can equally be applied to V-type and other engines with varying numbers of cylinders. Also, not only opposed exhaust and inlet valve 4-valve engines, but the invention may also be applied to 2-valve engines in which a single exhaust valve and a single inlet valve are provided for each cylinder. Naturally, a variety of other changes can be made within the scope of the invention.

POSSIBILITIES FOR INDUSTRIAL USE

The valve opening mechanism described above is applicable for compression pressure release-type engine braking and exhaust gas recycling devices in automobile and other engines.

What is claimed is:

1. A valve opening mechanism which has been equipped with a rocker arm that actuates to open by pushing a base extremity upward with a push rod and by pushing engine valves downward with a tip whenever it moves at an angle, and an actuator pin that is through mounted to slide freely facing in a vertical direction relative to the tip of the said rocker arm and equipped with a rocker hook stop by which the bottom of the tip of the rocker arm is restrained at a specific top position, and which is characterized in that the valve opening mechanism has been constructed so as to enable the opening of engine valves by pushing the said actuator pin downward during the exhaust stroke of the above-mentioned rocker arm.

2. The valve opening mechanism set forth in claim 1, characterized in that the actuator pin has a pin hook stop component at its longitudinal midsection, a spherical shape on a lower extremity, a tip with a rounded seat which slides freely to maintain contact between the spherical shape and rounded seat.

3. The valve opening mechanism set forth in claim 1 or claim 2, characterized in that the valve opening mechanism has been equipped with a master piston that operates by being thrown upward by the base edge of the rocker arm, a slave piston that opens the engine valves by pushing the actuator pin on the rocker arm tip provided in the appropriate cylinder downward whenever the slave piston is linked to the said master cylinder through the use of an oil line and pressure is generated in the said oil line by the action of the above-mentioned master cylinder, and a means to supply operating oil that alternates between sustaining and releasing oil pressure in the above-mentioned oil line.

* * * * *